US008119196B2

(12) United States Patent
Arisumi et al.

(10) Patent No.: US 8,119,196 B2
(45) Date of Patent: Feb. 21, 2012

(54) SEMICONDUCTOR MANUFACTURING APPARATUS, LIQUID CONTAINER, AND SEMICONDUCTOR DEVICE MANUFACTURING METHOD

(75) Inventors: Osamu Arisumi, Yokohama (JP); Masahiro Kiyotoshi, Sagamihara (JP); Katsuhiko Hieda, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 115 days.

(21) Appl. No.: 12/659,071

(22) Filed: Feb. 24, 2010

(65) Prior Publication Data

US 2010/0159710 A1 Jun. 24, 2010

Related U.S. Application Data

(62) Division of application No. 11/246,145, filed on Oct. 11, 2005, now abandoned.

(30) Foreign Application Priority Data

Oct. 27, 2004 (JP) ..... 2004-311927

(51) Int. Cl.
*B05D 3/12* (2006.01)

(52) U.S. Cl. ..... 427/240; 427/425; 118/52; 438/758

(58) Field of Classification Search ..... 427/240, 427/425; 118/52; 438/758
See application file for complete search history.

(56) References Cited

U.S. PATENT DOCUMENTS

| | | | | |
|---|---|---|---|---|
| 4,286,541 | A | 9/1981 | Blackwood | |
| 4,544,576 | A | 10/1985 | Chu et al. | |
| 5,195,680 | A | 3/1993 | Holt | |
| 5,590,695 | A | 1/1997 | Siegele et al. | |
| 5,607,000 | A | 3/1997 | Cripe et al. | |
| 5,765,072 | A | 6/1998 | Ohtani et al. | |
| 5,964,254 | A | 10/1999 | Jackson | |
| 2004/0224094 | A1 * | 11/2004 | Lee et al. | 427/387 |
| 2005/0051234 | A1 | 3/2005 | Steidl et al. | |

FOREIGN PATENT DOCUMENTS

| | | |
|---|---|---|
| JP | 7-142459 | 6/1995 |
| JP | 3178412 | 4/2001 |
| JP | 2003-146399 | 5/2003 |
| JP | 2005-236050 | 9/2005 |

OTHER PUBLICATIONS

Decision of Final Rejection issued by the Japanese Patent Office on Feb. 26, 2010, for Japanese Patent Application No. 2004-311927, and English-language translation thereof.

Notification of Reasons for Rejection mailed by the Japanese Patent Office on Sep. 29, 2009, for Japanese Patent Application No. 2004-311927.

* cited by examiner

*Primary Examiner* — Kirsten Jolley
(74) *Attorney, Agent, or Firm* — Finnegan, Henderson, Farabow, Garrett & Dunner, L.L.P.

(57) ABSTRACT

A semiconductor manufacturing apparatus comprises a discharge portion discharging a coating liquid onto a substrate; a gas supply tube supplying an inert gas into a liquid container that contains the coating liquid, and pressurizing an interior of the liquid container; a coating liquid supply tube airtightly supplying the coating liquid from the liquid container to the discharge portion using pressurization from the gas supply tube; a first connecting portion capable of attaching and detaching the liquid container to and from the coating liquid supply tube; a second connecting portion capable of attaching and detaching the liquid container to and from the gas supply tube; and a solvent supply tube supplying a solvent, which can dissolve the coating liquid, to the first connecting portion.

6 Claims, 13 Drawing Sheets

| | THE NUMBERS OF PARTICLES HAVING VARIOUS PARTICLE DIAMETERS | | | | |
|---|---|---|---|---|---|
| | 0.2~0.4 [μm] | 0.4~0.6 [μm] | 0.6~0.8 [μm] | 0.8~1.0 [μm] | AT LEAST 1.0 [μm] |
| THE CONVENTIONAL TECHNIQUE (FIG.12) | 477 | 45 | 13 | 5 | 20 |
| THE FIRST EMBODIMENT | 0 | 0 | 0 | 0 | 0 |
| THE SECOND AND THE THIRD EMBODIMENTS | 0 | 1 | 0 | 0 | 0 |
| THE FOURTH TO SIXTH EMBODIMENTS | 1 | 0 | 0 | 0 | 0 |

FIG. 13

SEMICONDUCTOR MANUFACTURING APPARATUS, LIQUID CONTAINER, AND SEMICONDUCTOR DEVICE MANUFACTURING METHOD

CROSS-REFERENCE TO RELATED APPLICATION

This application is a divisional of application Ser. No. 11/246,145, filed Oct. 11, 2005 now abandoned, and is based upon and claims the benefit of priority from the prior Japanese Patent Application No. 2004-311927, filed on Oct. 27, 2004, the entire contents of both of which are incorporated herein by reference.

BACKGROUND OF THE INVENTION

1. Field of the Invention

The present invention relates to a semiconductor manufacturing apparatus, a liquid container and a semiconductor device manufacturing method.

2. Related Art

A semiconductor device such as a NAND flash memory is required to bury a silicon oxide film in a trench having a high aspect ratio so as to form deep STI (shallow trench isolation) in a narrow region.

To meet this demand, a film formation technique for using both an HDP (high density plasma) film and an SOG (spin on glass) film has been developed (see Japanese Patent No. 3178412). According to this technique, a silicon oxide film is deposited by HDP-CVD (chemical vapor deposition), and a film coated with a perhydropolysilazane liquid (hereinafter, "PSZ (Polysilazane)") is coated on the silicon oxide film by spin coating. The coated film is then silicified by a cure treatment. It is thereby possible to bury the silicon oxide film in a trench having a high aspect ratio.

FIG. 14 is a conceptual view showing a conventional SOG step. Normally, a bottled PSZ liquid filled with nitrogen is commercially available. When a bottle cap is opened at a time of a used PSZ bottle being replaced by a new one, the air never fails to enter the bottles. In addition, during the replacement, the air may possibly enter a PSZ liquid supply nozzle from a tip end of the PSZ liquid supply nozzle. If so, the PSZ liquid unavoidably contacts with the air.

The PSZ developed to be silicified at a temperature as low as about several hundred Celsius (° C.) can react with water and oxygen as represented by Chemical Formula 1, and can be solidified even at a room temperature when being exposed to the atmosphere.

$$—(SiH_2NH)_n—+2nO \rightarrow nSiO_2+nNH_3 \quad \text{(Formula 1)}$$

When the PSZ is solidified in a piping from a PSZ container to a discharge nozzle, the solidified PSZ fixedly adheres onto a semiconductor substrate after being discharged together with the PSZ-coating liquid, thereby disadvantageously causing bulges, divots, and streaks. Even if the solidified PSZ is not formed, the air mixed into the piping and discharged onto the semiconductor substrate as air bubbles may possibly cause the bulges, divots, and streaks. Furthermore, the solidified PSZ may possibly damage the semiconductor substrate and a polishing cloth or cause a contamination during CMP (Chemical Mechanical Polish) process.

When the PSZ remains in the used container, the PSZ reacts with water and oxygen to generate ammonium ($NH_3$) and silane ($SiH_4$). The ammonium and silane bring about considerably serious environmental and safety problems. It is, therefore, difficult to manage and handle the PSZ and the PSZ container in manufacturing of semiconductor products.

In these circumstances, therefore, a semiconductor manufacturing apparatus, which airtightly transports a liquid to be coated on a substrate from a container to a discharge portion and suppresses the liquid from coming in contact with the air when the container is replaced by another one, has been desired.

Furthermore, a liquid container detachable from the semiconductor manufacturing apparatus, which airtightly transports the liquid to be coated on the substrate from the container to the discharge portion and suppresses the liquid from coming in contact with the air when the container is replaced by another one, has been desired.

SUMMARY OF THE INVENTION

A semiconductor manufacturing apparatus according to an embodiment of the present invention comprises a discharge portion discharging a coating liquid onto a substrate; a gas supply tube supplying an inert gas into a liquid container that contains the coating liquid, and pressurizing an interior of the liquid container; a coating liquid supply tube airtightly supplying the coating liquid from the liquid container to the discharge portion using pressurization from the gas supply tube; a first connecting portion capable of attaching and detaching the liquid container to and from the coating liquid supply tube; a second connecting portion capable of attaching and detaching the liquid container to and from the gas supply tube; and a solvent supply tube supplying a solvent, which can dissolve the coating liquid, to the first connecting portion.

A semiconductor manufacturing apparatus according to an embodiment of the present invention comprises a discharge portion discharging a coating liquid onto a substrate; a gas supply tube supplying an inert gas into a liquid container that contains the coating liquid, and pressurizing an interior of the liquid container; a coating liquid supply tube airtightly supplying the coating liquid from the liquid container to the discharge portion using pressurization from the gas supply tube; a first connecting portion capable of attaching and detaching the liquid container to and from the coating liquid supply tube; a second connecting portion capable of attaching and detaching the liquid container to and from the gas supply tube; and a liquid bath including the solvent capable of dissolving the coating liquid, wherein the first connecting portion and the second connecting portion are present in the liquid bath.

A liquid container according to an embodiment of the present invention which contains a coating liquid and which is undesirable to expose to the atmosphere before utilizing for semiconductor manufacturing, the liquid container being attachable to or detachable from a semiconductor manufacturing apparatus, wherein the liquid container seals a coating liquid and a protection liquid, which is lower specific gravity than that of the coating liquid and does not react with the coating liquid, in a pressurized atmosphere with an inert gas higher than the atmospheric pressure.

A semiconductor manufacturing method using a semiconductor manufacturing apparatus according to an embodiment of the present invention comprises a discharge portion discharging a coating liquid onto a substrate; a gas supply tube pressurizing an interior of the liquid container with an inert gas; a coating liquid supply tube airtightly supplying the coating liquid from the liquid container to the discharge portion using pressurization from the gas supply tube; a first connecting portion capable of attaching and detaching the liquid container to and from the coating liquid supply tube; a second connecting portion capable of attaching and detaching the liquid container to and from the gas supply tube; and an exhaust tube capable of reducing an internal pressure of the coating liquid supply tube including the first connecting portion:

the method comprising:

attaching the liquid container to the first connecting portion and the second connecting portion;

supplying the inert gas to the liquid container via the gas supply tube, thereby carrying the coating liquid to the discharge portion via the coating liquid supply tube;

discharging the coating liquid to the substrate from the discharge portion;

reducing an internal pressure of the liquid container via the exhaust tube and the second connecting portion after discharging the coating liquid; and returning the coating liquid in the first connecting portion and the liquid supply tube to the liquid container by using the pressure in the liquid container.

BRIEF DESCRIPTION OF THE DRAWINGS

FIG. 13 is a table that shows effects of the respective embodiments of the present invention.

DETAILED DESCRIPTION OF THE INVENTION

Hereafter, exemplary embodiments of the present invention will be described more specifically with reference to the drawings. Note that the invention is not limited to the embodiments.

First Embodiment

Figure 1:
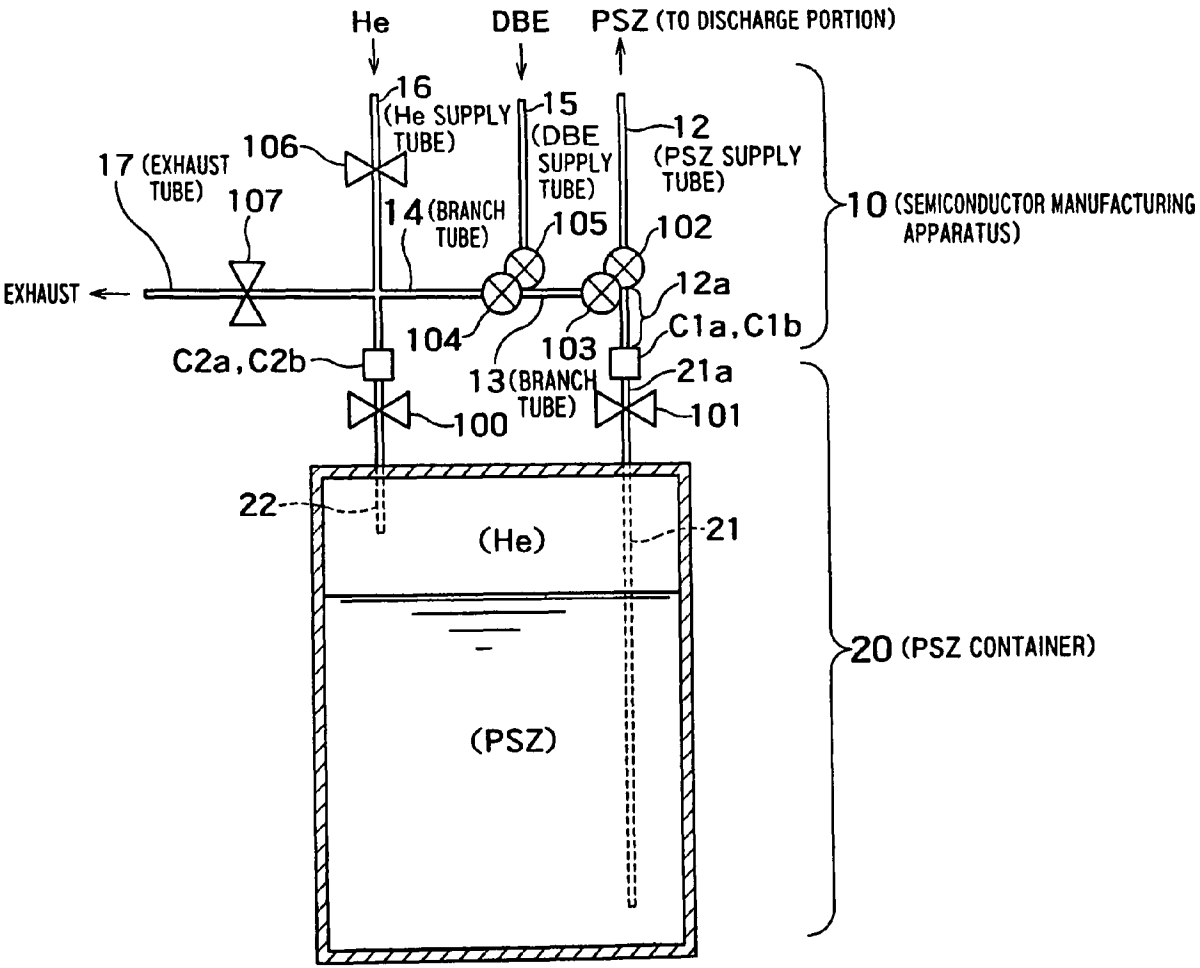
FIG. 1 is a schematic diagram of a semiconductor manufacturing apparatus and a PSZ container according to a first embodiment of the present invention.

FIG. 1 is a schematic diagram of a semiconductor manufacturing apparatus 10 and a PSZ container 20 according to a first embodiment of the present invention. The semiconductor manufacturing apparatus 10 is an apparatus for dropping a PSZ liquid from a discharge nozzle onto a semiconductor substrate, and spreading the PSZ liquid on the semiconductor substrate by spin coating at an SOG step.

The semiconductor manufacturing apparatus 10 includes a coating liquid discharge portion (not shown), a PSZ supply tube 12 serving as a coating liquid supply tube, a dibutyl ether supply tube (hereinafter, "DBE supply tube") 15 serving as a solvent supply tube, a helium supply tube (hereinafter, "He supply tube") 16 serving as a gas supply tube, an exhaust tube 17, and branch tubes 13 and 14. Since the discharge portion may be identical to the discharge nozzle shown in FIG. 14, it is not shown in FIG. 1.

The semiconductor manufacturing apparatus 10 also includes a connector C1*a* serving as a first connecting portion and a connector C2*a* serving as a second connecting portion. The PSZ supply tube 12 is connected to the connector C1*a* through a valve 102. One end of the branch tube 13 is connected to the PSZ supply tube 12 between the valve 102 and the connector C1*a* through a valve 103. The other end of the branch tube 13 is connected to one end of the branch tube 14 through a valve 104, and also connected to the DBE supply tube 15 through a valve 105.

The He supply tube 16 is connected to the connector C2*a* through a valve 106. The other end of the branch tube 14 is connected to the He supply tube 16 between the valve 106 and the connector C2*a*, and the exhaust tube 17 is connected to the He supply tube 16 through a valve 107. A vacuum pomp, e.g., a turbomolecular pump, not shown, is connected to the exhaust pipe 17.

Figure 2:
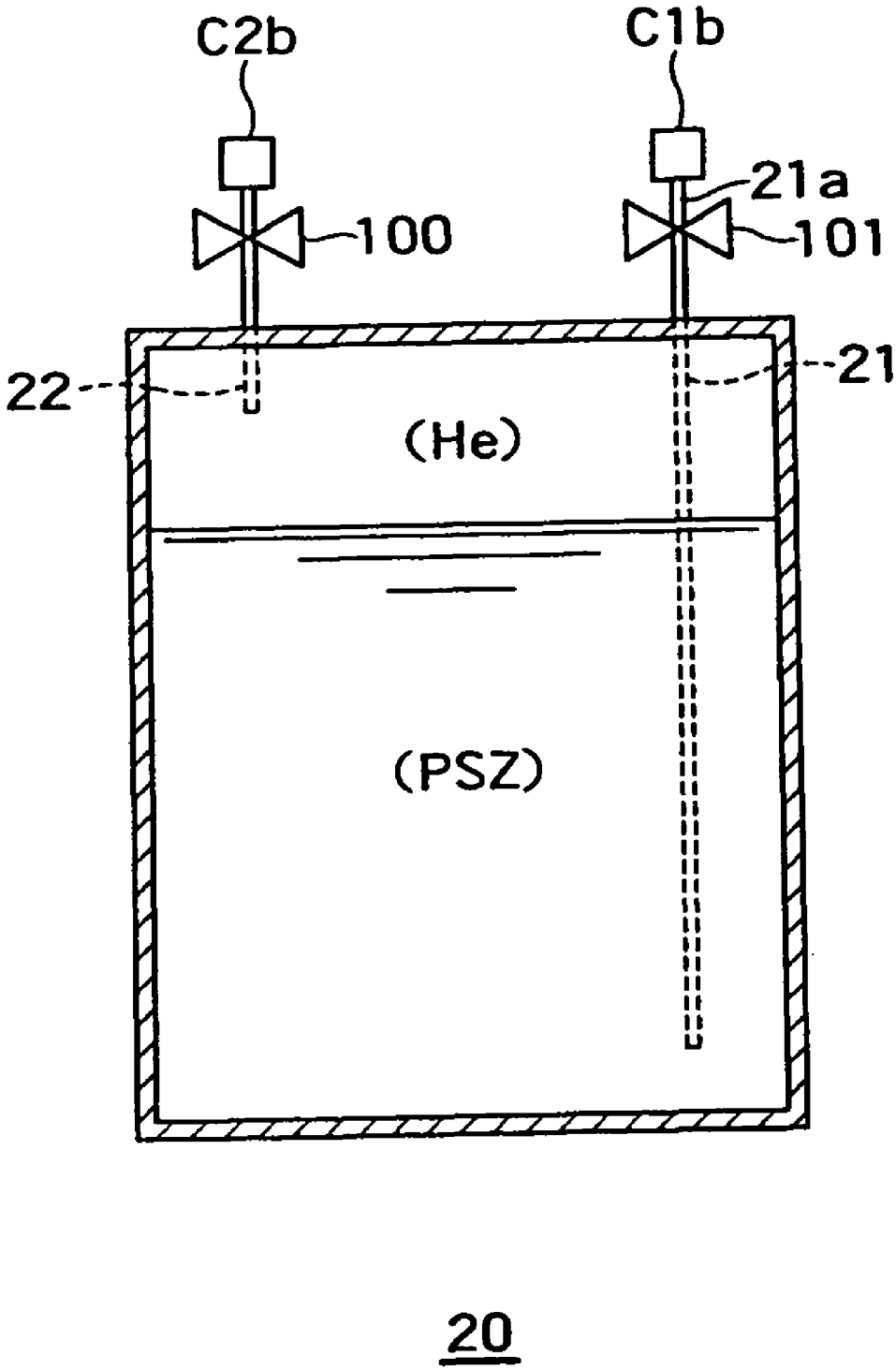
FIG. 2 shows a PSZ container 20.

As shown in FIG. 2, the PSZ container. 20 includes a pair of connectors C1*b* and C2*b* connectable to the connectors C1*a* and C2*a* of the semiconductor manufacturing apparatus 10, respectively. The PSZ container 20 can be thereby attached to or detached from the PSZ supply tube 12 and the He supply tube 16.

The PSZ container 20 also includes a PSZ outlet tube 21 provided from the connector C1*b* to neighborhoods of a bottom of the container 20, and a He inlet tube 22 provided from the connector C2*b* to neighborhoods of an upper surface of the container 20. Valves 101 and 100 are provided at the PSZ outlet tube 21 near the connector C1*b* and the He inlet tube 22 near the connector C2*b*, respectively, whereby an interior of the PSZ container 20 is shut off from the atmosphere.

The PSZ container 20 is withdrawn in a sealed state after usage and recyclable by filling a PSZ liquid again into the container 20. An inert gas as well as the PSZ liquid is filled into the PSZ container 20 with the inert gas pressurized at a slightly higher pressure than an atmospheric pressure. By doing so, the air is not mixed into the PSZ container 20. The PSZ liquid is contained in the PSZ container 20 up to a portion near the valve 100 but contained so as not to reach the valve 100. It is thereby possible to prevent air bubbles from being generated in the PSZ liquid. The PSZ liquid is contained in the PSZ container 20 in a state, for example, in which the PSZ liquid is dissolved into a solvent such as dibutyl ether (hereinafter, "DBE").

The inert gas filled into the PSZ container 20 is preferably the same as the inert gas, i.e., helium gas supplied to the semiconductor manufacturing apparatus 10 for the following reasons. The helium possesses a property that it is insoluble with an organic solvent such as the PSZ or DBE, and the helium is less expensive than the other inert gas such as xenon. The PSZ container 20 and the semiconductor manufacturing apparatus 10 are preferably made of stainless steel (SUS). However, the material for the PSZ container 20 and the semiconductor manufacturing apparatus 10 is not limited to SUS but may be an arbitrary material that has good airtightness, that does not react with the PSZ, and that does not cause a metal contamination.

(PSZ Supply Operation)

When the PSZ liquid is supplied to the discharge portion, the PSZ supply tube 12 and the He supply tube 16 are used but the DBE supply tube 15 and the exhaust tube 17 are not used. Due to this, the valves 100, 101, 102, and 106 are open whereas the valves 103, 104, 105, and 107 are closed. In this state, the He supply tube 16 supplies the He gas to the PSZ container 20 to pressurize an interior of the PSZ container 20. An internal atmospheric pressure of the PSZ container 20 is made thereby higher than a surrounding atmospheric pressure, so that the PSZ liquid is supplied to the discharge portion through the PSZ supply tube 12. At this time, the PSZ supply tube 12 airtightly supplies the PSZ liquid from the PSZ container 20 to the discharge portion. The discharge portion discharges the coating liquid onto the semiconductor substrate (see FIG. 14).

(PSZ Container Detachment Operation)

Figure 3:
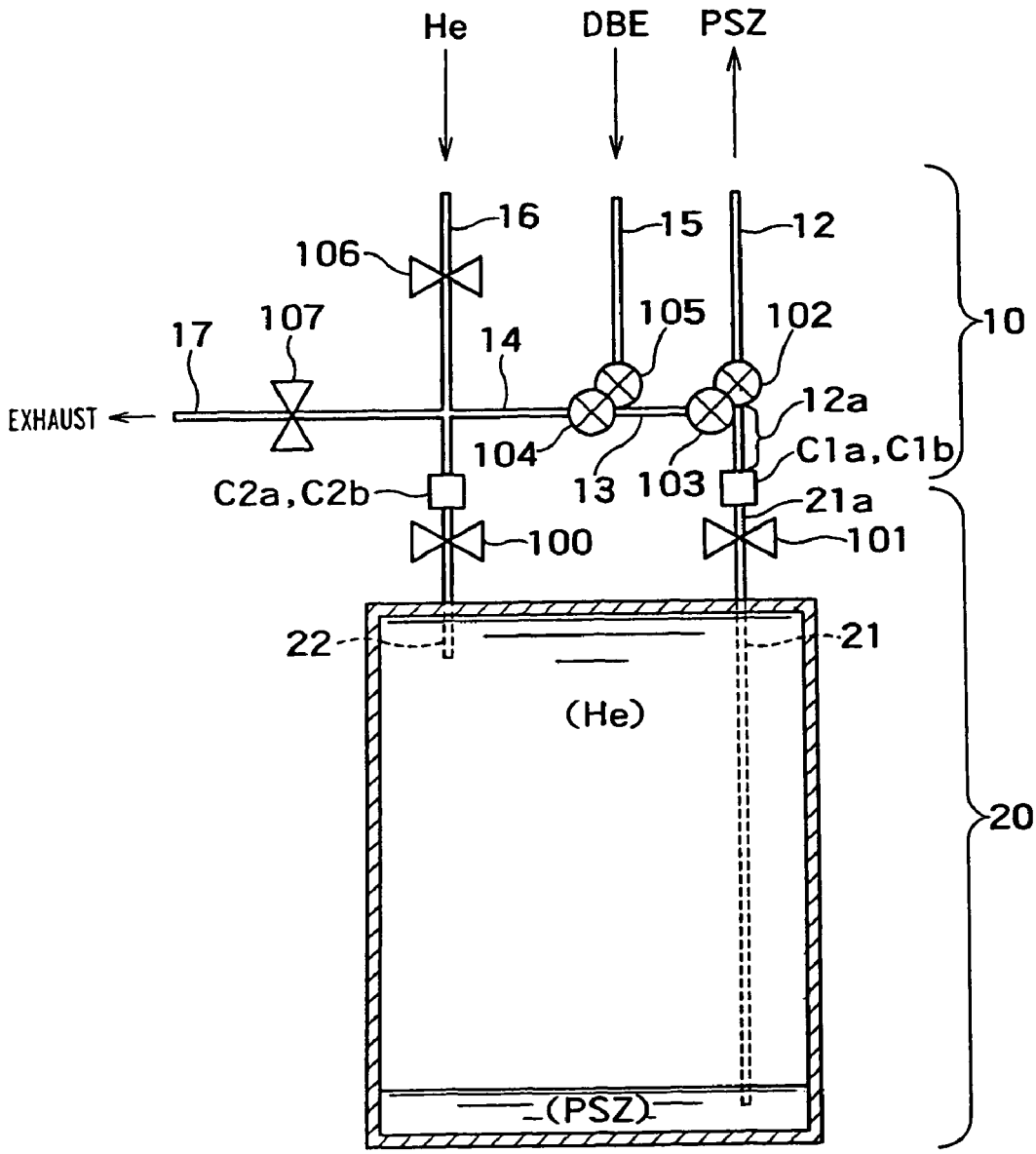
FIG. 3 shows an operation for detaching the PSZ container 20.
Figure 4:
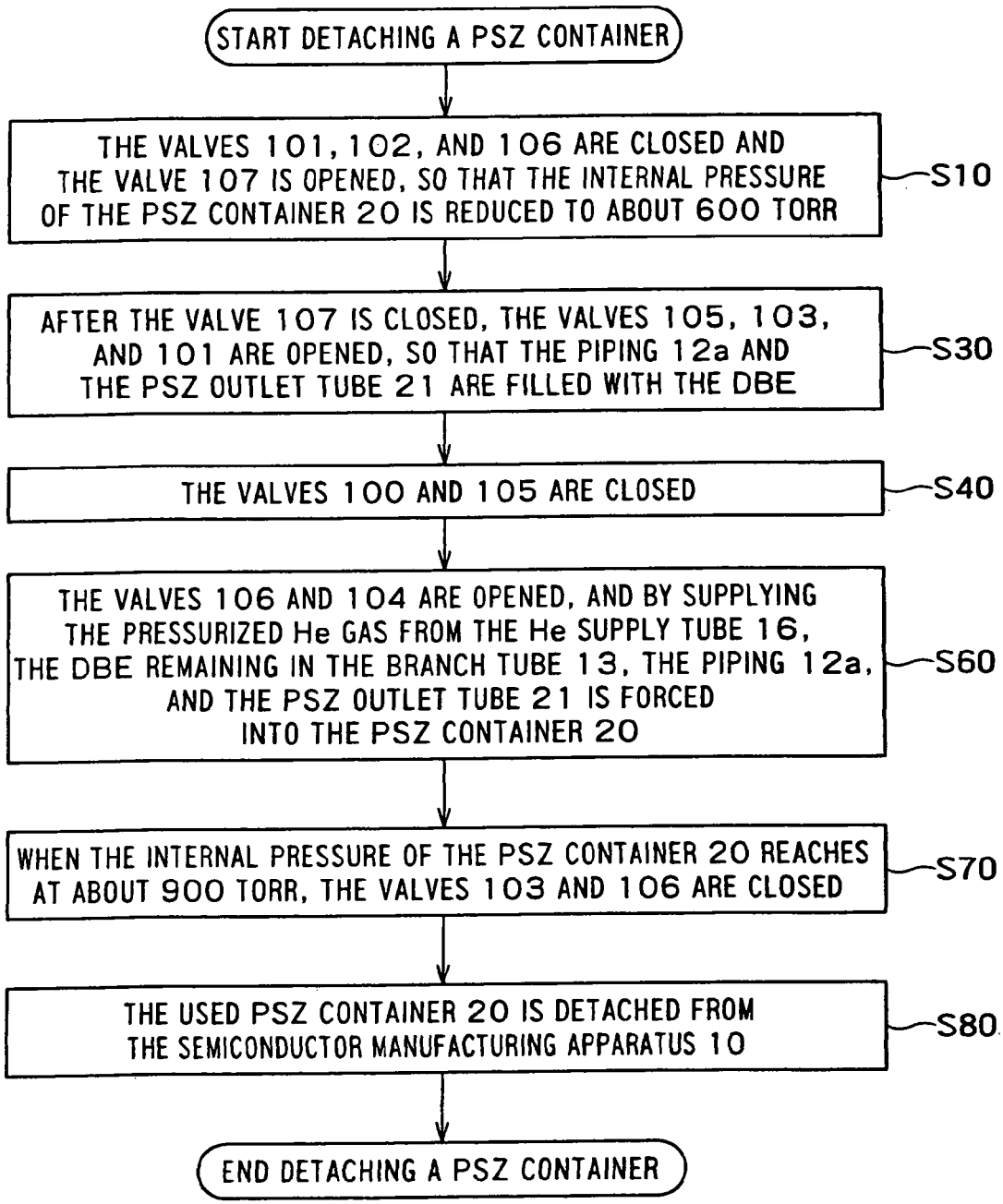
FIG. 4 is a flowchart that shows a flow of an operation for detaching the PSZ container 20.

FIG. 3 shows a manner of detaching the PSZ container 20 from the semiconductor manufacturing apparatus 10. FIG. 4 is a flowchart that shows a flow of an operation for detaching the PSZ container 20. With reference to FIGS. 3 and 4, the operation for detaching the PSZ container 20 will be described.

When the PSZ liquid is supplied to the discharge portion and a residual amount of the PSZ liquid in the PSZ container 20 is small, it is necessary to replace the PSZ container 20 by a new PSZ container 20. At this time, if the valves 100, 101, 102, and 106 are simply closed to disconnect the connector C1*a* from the connector C1*b* and the connector C2*a* from the connector C2*b*, the PSZ liquid remaining in the PSZ supply tube 12 from the connector C1*a* to the valve 102 may possibly come in contact with the air.

To prevent this contact, when the PSZ container 20 is detached, the valves 101, 102, and 106 are closed in this order and the valve 107 is opened (at a step S10). At this step, since the valves 100 and 107 are open, the exhaust pipe 17 communicates with the PSZ container 20 while the valves other than the valves 100 and 107 are closed. The internal pressure of the PSZ container 20 is thereby reduced to about 600 Torr through the exhaust tube 17 (at a step S10).

After the valve 107 is closed, the valves 105, 103, and 101 are opened in this order. At this time, the internal pressure of the PSZ container 20 is lower than the atmospheric pressure (about 760 Torr). Due to this, DBE is supplied into the PSZ container 20 through the DBE supply tube 15, the branch tube 13, the PSZ supply tube from the valve 102 to the connector C1*a* (hereinafter, the PSZ supply tube 12 in this section will be referred to as "piping 12*a*"), and the PSZ outlet tube 21. The PSZ liquid remaining in the piping 12*a* and the PSZ outlet tube 21 is thereby forced into the PSZ container 20. At the same time, the piping 12*a* and the PSZ outlet tube 21 are filled with the DBE (at a step S30).

After the internal pressure of the PSZ container 20 is identical to the atmospheric pressure, the valves 100 and 105 are closed (at a step S40). The valves 106 and 104 are then opened in this order. The He supply tube 16 thereby communicates with the PSZ container 20 through the branch tubes 14 and 13. By supplying the pressurized He gas from the He supply tube 16, the DBE remaining in the branch tube 13, the piping 12*a*, and the PSZ outlet tube 21 is forced into the PSZ container 20 (at a step S60). When the internal pressure of the PSZ container 20 reaches at about 900 Torr, the valves 103 and 106 are closed (at a step S70). Thereafter, the connector C1*a* is disconnected from the connector C1*b*, and the connector C2*a* is disconnected from the connector C2*b*, and the used PSZ container 20 is detached from the semiconductor manufacturing apparatus 10 (at a step S80).

Since the He gas at the higher pressure than the atmospheric pressure is filled into the used PSZ container 20, the air is not mixed into the PSZ container 20. It is, therefore, possible to prevent oxygen and water from reacting with the PSZ liquid in the PSZ container 20.

When the used PSZ container 20 is detached from the semiconductor manufacturing apparatus 10, the PSZ supply tube 12 from the valve 102 to the discharge portion is filled with the PSZ liquid. The piping 12*a* and a piping (hereinafter, "piping 21*a*") from the connector C1*b* of the PSZ container 20 to the valve 101 are exposed to the atmosphere. In this embodiment, however, the piping 12*a* is washed by the DBE used as the solvent for the PSZ liquid in the PSZ container 20, no PSZ liquid remains in the piping 12*a*. Therefore, no PSZ solid matter is generated in the pipings 12*a* and 21*a*.

(PSZ Container Attachment Operation)

Figure 5:
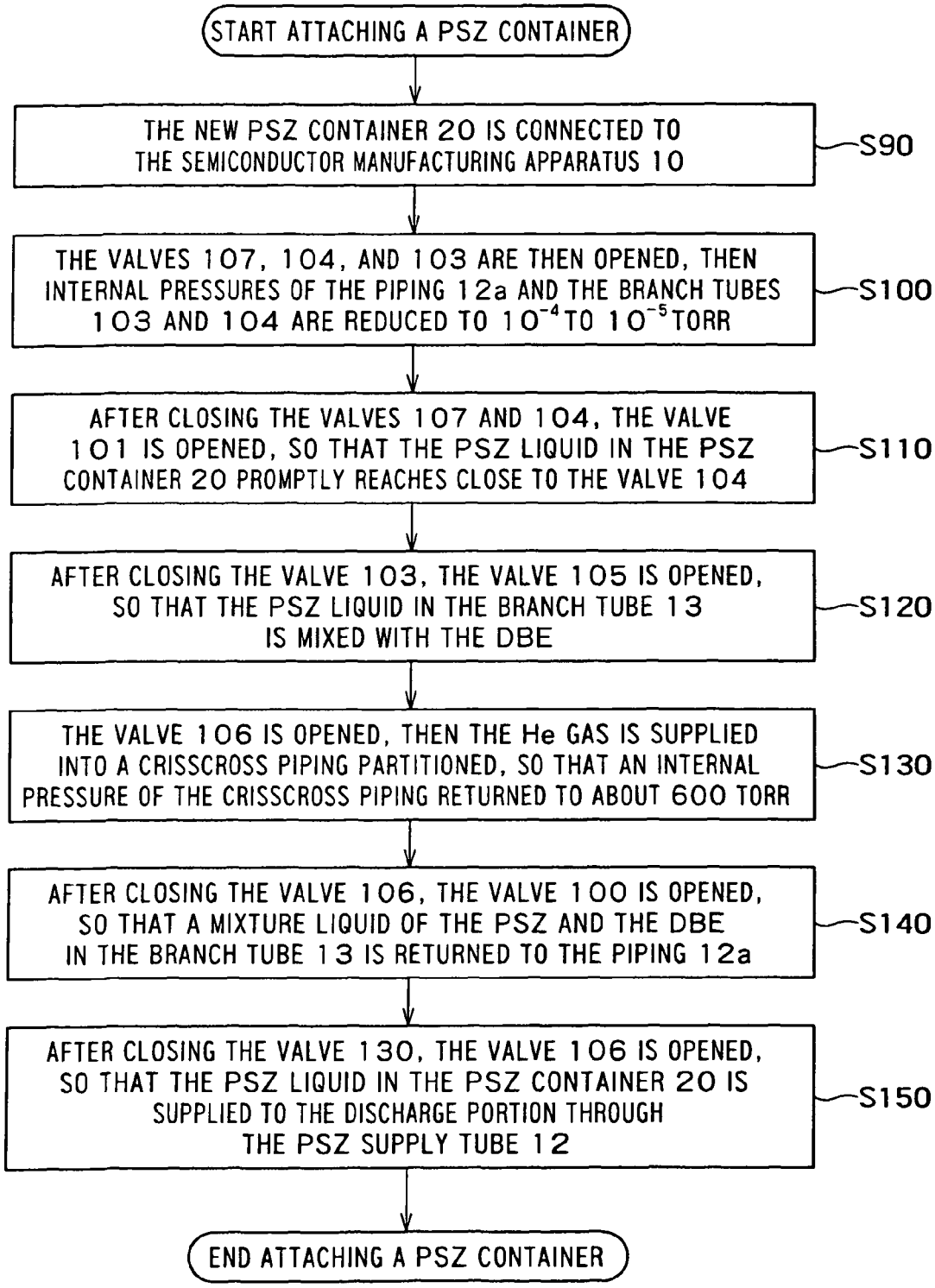
FIG. 5 is a flowchart that shows a flow of an operation for attaching the PSZ container 20.

FIG. 5 is a flowchart that shows a flow of an operation for attaching the PSZ container 20 to the semiconductor manufacturing apparatus 10. With reference to FIGS. 1 and 5, an operation for attaching the new PSZ container 20 to the apparatus 10 will be described.

Although no PSZ liquid is contained in the piping 21*a* of the new PSZ container 20, the piping 21*a* is exposed to the atmosphere. Due to this, it is necessary to take care not to contact the air present in the pipings 12*a* and 21*a* with the PSZ liquid.

The new PSZ container 20 is connected to the semiconductor manufacturing apparatus 10 (at a step S90). At this time, all the valves 100 to 107 are closed. The valves 107, 104, and 103 are then opened in this order. Internal pressures of the piping 12*a* and the branch tubes 103 and 104 are reduced to $10^{-4}$ to $10^{-5}$ Torr (at a step S100).

After closing the valves 107 and 104 in this order, the valve 101 is opened. At this time, a piping including the piping 12*a* from the valve 101 to the valve 103 and the branch tube 13 are in a low pressure state close to a vacuum. Therefore, the PSZ liquid in the PSZ container 20 promptly reaches close to the valve 104 (at a step S110).

After closing the valve 103, the valve 105 is opened. The PSZ liquid in the branch tube 13 is thereby mixed with the DBE (at a step S120).

Next, the valve 106 is opened, the He gas is supplied into a crisscross piping partitioned by the valves 100, 107, 106, and 104, and an internal pressure of the crisscross piping is thereby returned to about 600 Torr (at a step S130). After closing the valve 106, the valve 100 is opened. At this time, the internal pressure of the crisscross piping partitioned by the valves 100, 107, 106, and 104 is slightly lower than the atmospheric pressure. Due to this, a mixture liquid of the PSZ, and the DBE in the branch tube 13 is returned to at least the piping 12*a* (at a step S140). Since the DBE liquid is used as the solvent for the PSZ liquid in the PSZ container 20, no problem occurs even if a small amount of the mixture liquid enters the PSZ container 20. It is noted that He air bubbles are sometimes mixed into this mixture liquid of the PSZ and the DBE.

After closing the valve 103, the valve 106 is opened (at a step S150). The PSZ liquid in the PSZ container 20 can be thereby supplied to the discharge portion through the PSZ supply tube 12. Since the initially supplied liquid is either the mixture liquid of the PSZ and the DBE or the mixture liquid containing the He air bubbles, the liquid is disposed of.

When the amount of the PSZ liquid in the PSZ container 20 is reduced, the detachment operation and the attachment operation for detaching and attaching the PSZ container 20 are repeatedly carried out according to the steps S10 to S150. As described above, according to the first embodiment, the PSZ liquid can be supplied to the discharge portion without exposure to the air.

In recent years, following an increase in the aspect ratio of STI, it has been difficult to bury the silicon oxide film in the trench. The STI in the NAND flash memory is, in particular, high in aspect ration as compared with a logic circuit, and required to bury the silicon oxide film in a non-tapered trench.

When the present embodiment is applied, such defects as bumps, divots, and streaks can be prevented even at manufacturing steps of a NAND flash memory with a trench having an opening width of, for example, 90 to 70 nm. This can contribute to an improvement in the yield of semiconductor devices.

Furthermore, in the used PSZ container 20, the residual liquid does not contact with the atmosphere and no hazardous and ignitable gas such as ammonium or silane is generated.

The valves 102 to 105 are preferably gate valves, e.g., block valves, without any excessive space at branch portions.

Second Embodiment

Figure 6:
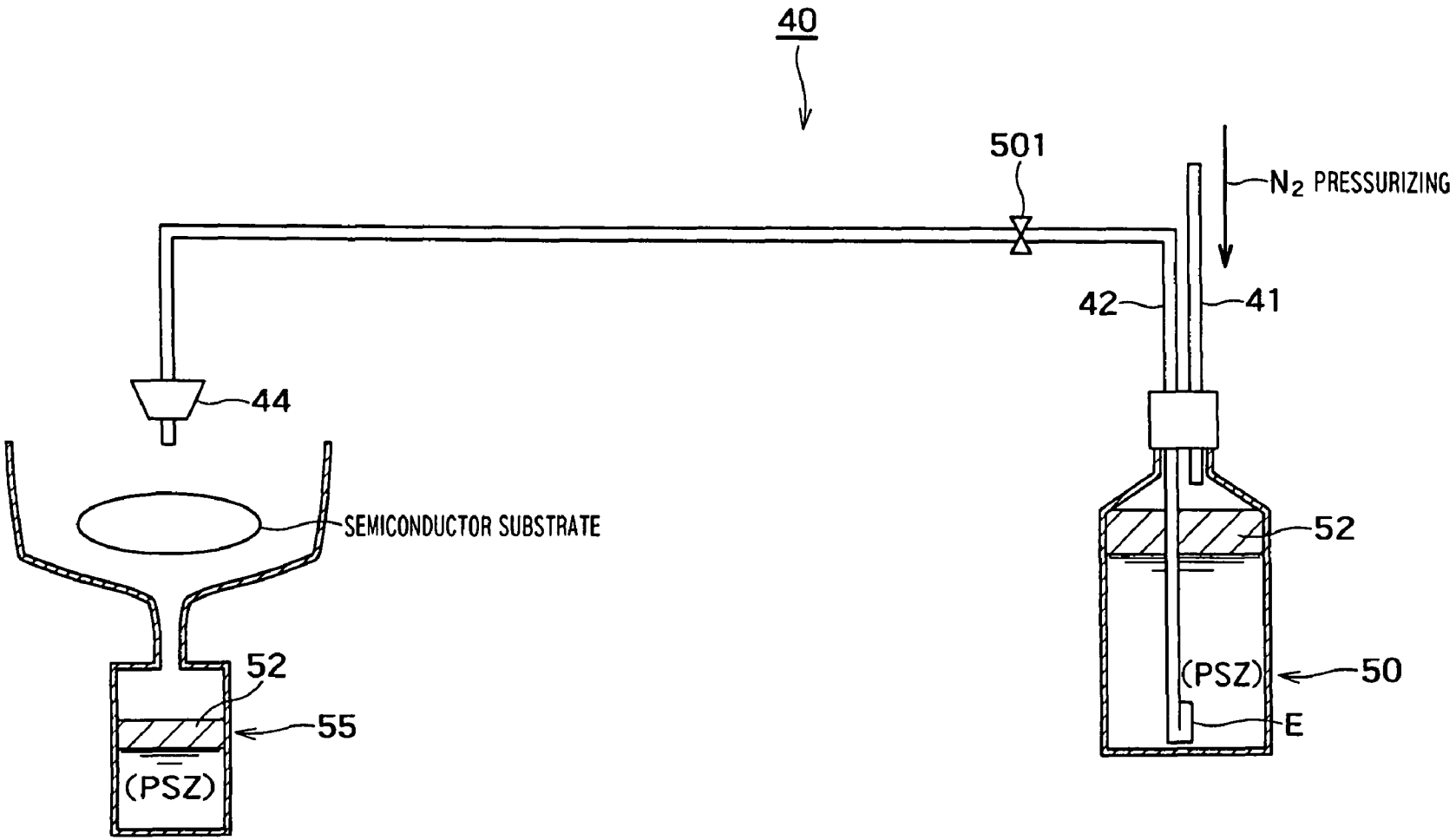
FIG. 6 is a schematic diagram of a semiconductor manufacturing apparatus and a PSZ container according to a second embodiment of the present invention.

FIG. 6 is a schematic diagram of a semiconductor manufacturing apparatus 40 and a PSZ container 50 according to a second embodiment of the present invention. The semiconductor manufacturing apparatus 40 differs from the semiconductor manufacturing apparatus shown in FIG. 14 in that a tip end of a PSZ supply tube 42 is formed into a "J" shape. The other constituent elements of the semiconductor manufacturing apparatus 40 may be identical to those of the semiconductor manufacturing apparatus shown in FIG. 14. The PSZ container 50 contains not only a PSZ liquid but also a protection liquid 52 that shuts off the PSZ liquid from the atmosphere. The other constituent elements of the PSZ container 50 may be identical to those of the PSZ container shown in FIG. 14.

Figure 14:
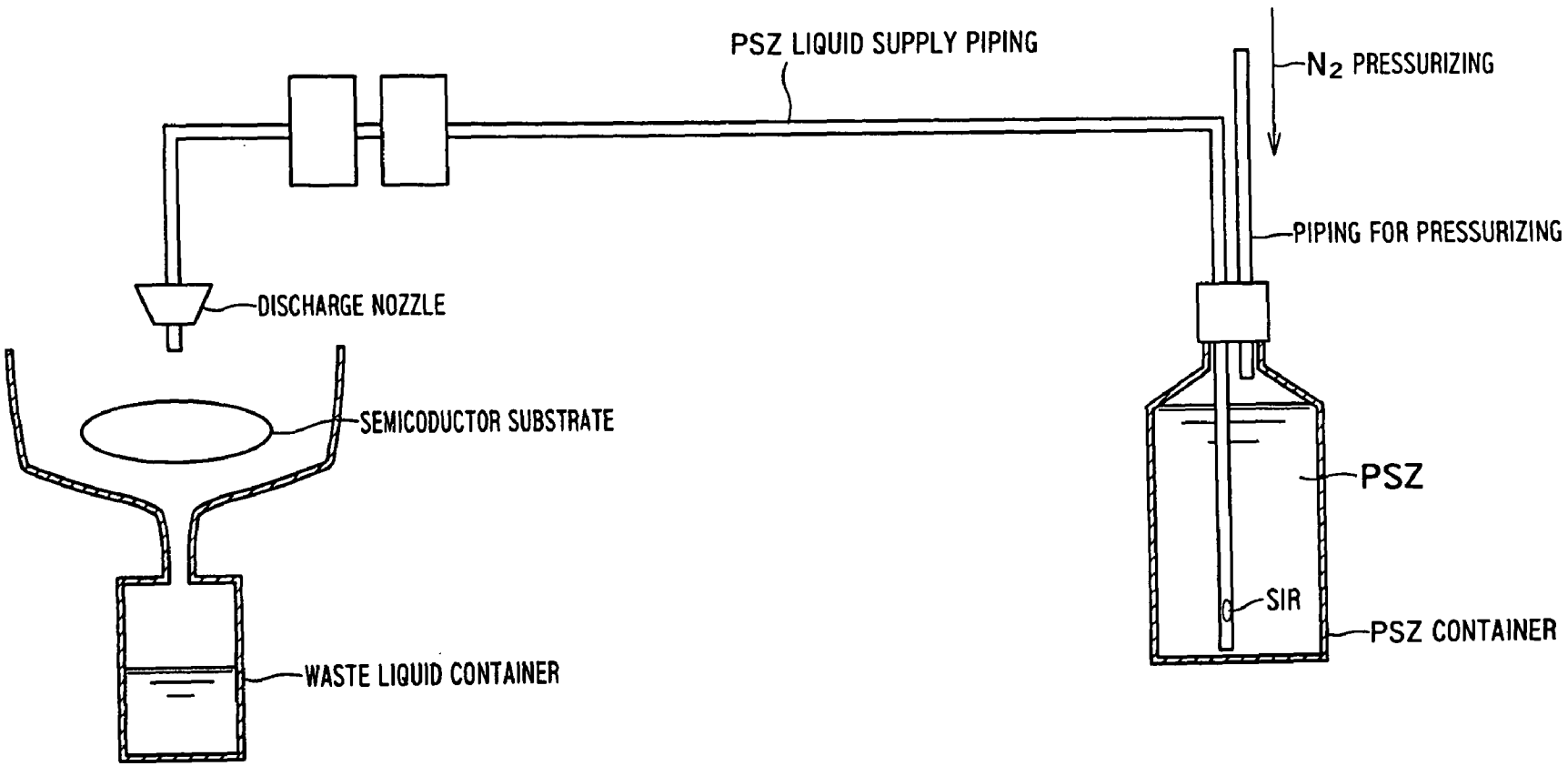
FIG. 14 is a schematic diagram showing a conventional SOG step.

In the semiconductor manufacturing apparatus shown in FIG. 14, an end of the PSZ supply tube is directed downward. Due to this, when the PSZ container is attached to the semiconductor manufacturing apparatus, air bubbles tend to be mixed into the PSZ supply tube. When the air bubbles are oxygen or water bubbles, they may disadvantageously cause the PSZ liquid to be solidified. When the air bubbles are inert gas bubbles such as helium bubbles, the PSZ liquid is disadvantageously difficult to discharge from the discharge portion.

In the semiconductor manufacturing apparatus 40 according to the second embodiment, by contrast, an end of the PSZ supply tube 42 is directed upward. This can make it more difficult to mix air bubbles into the PSZ supply tube 42 when the PSZ container 50 is attached to the semiconductor manufacturing apparatus 40. It is noted that the PSZ container 50 is attached to the semiconductor manufacturing apparatus 40 after a valve 501 is closed. By doing so, even while the PSZ container 50 is being attached to the apparatus 40, the PSZ liquid remains at the tip end of the PSZ supply tube 42.

Figure 7:
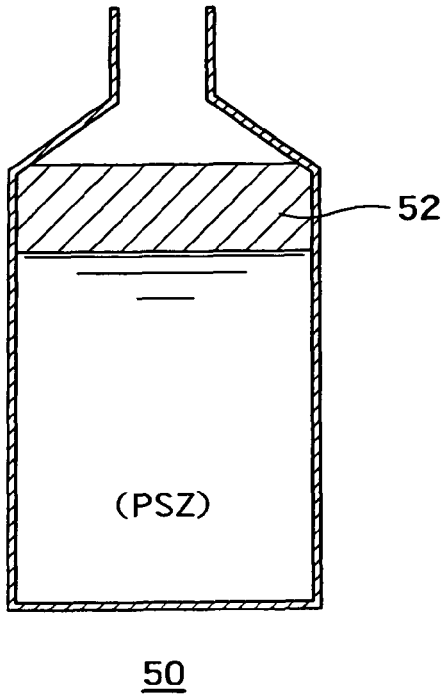
FIG. 7 is a cross-sectional view of a PSZ container according to the second embodiment.
Figure 8:
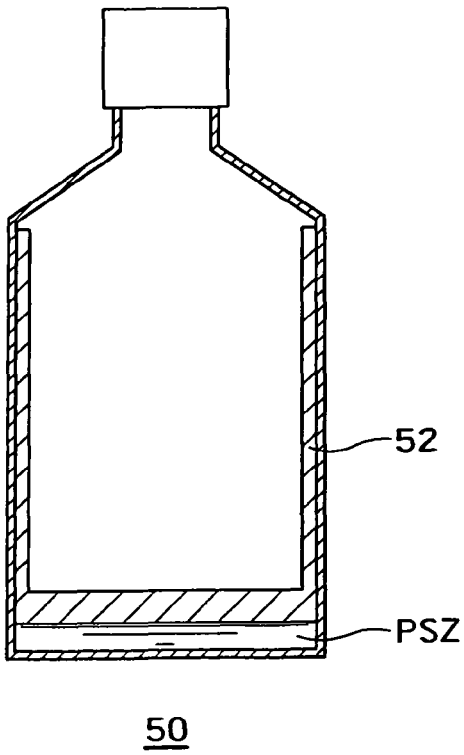
FIG. 8 is a cross-sectional view of a PSZ container according to the second embodiment.

FIGS. 7 and 8 are cross-sectional views of the PSZ container 50 according to the second embodiment. FIG. 7 shows the PSZ container 50 when being attached to the semiconductor manufacturing apparatus 40, and FIG. 8 shows the PSZ container 50 when being detached from the semiconductor manufacturing apparatus 40.

Desirable conditions for the protection liquid 52 that covers the PSZ in the PSZ container 50 are: no reaction with the PSZ liquid (condition 1), lower specific gravity than that of the PSZ liquid and no mixture with the PSZ liquid (condition 2), higher wettability with an inner wall of the PSZ container 50 than that of the PSZ liquid (condition 3), and non-inclusion of carbon (C) in impurities (condition 4). The conditions 1 and 2 are necessary conditions. Examples of a material that satisfies the conditions 1 and 2 include straight-chain-hydrocarbon and cyclic cyclohexane.

When the protection liquid 52 satisfies the conditions 1 and 2, the protection liquid 52 can cover a liquid level of the PSZ liquid in the PSZ container 50. When the protection liquid 52 satisfies the conditions 3, the protection liquid 52 can cover the inner wall of the PSZ container 50 and the residual PSZ liquid tends to reside on a bottom of the PSZ container 50 as shown in FIG. 8. It is thereby possible to ensure that the PSZ liquid is shut off from the atmosphere. The condition 4 is intended to eliminate carbon that may have a conductive type of either p or n as much as possible.

In the second embodiment, when the new PSZ container 50 is attached to the semiconductor manufacturing apparatus 40, the air enters the PSZ container 50. However, since the protection liquid 52 covers the surface of the PSZ, it is possible to prevent contact of the PSZ with the air. Further, when the used PSZ container 50 is detached from the semiconductor manufacturing apparatus 40, it is possible to prevent the contact of the PSZ liquid with the air since the protection film 52 covers the surface of the PSZ. In addition, while the PSZ liquid is being supplied, the liquid level of the PSZ is lowered. However, since the protection liquid 52 has a favorable wettability, the protection liquid 52 even covers the surface of the PSZ adhering to the inner wall of the PSZ container 50.

As shown in FIG. 8, even if the PSZ container 50 is temporarily held at a different location, the air in the PSZ container 50 does not contact with the PSZ liquid and no ammonium or silane is, therefore, generated in the PSZ container 50.

When the PSZ container 50 is attached to the semiconductor manufacturing apparatus 40, the protection liquid 52 enters the PSZ supply tube 42. However, since the specific gravity of the protection liquid 52 is lower than that of the PSZ liquid and the tip end of the PSZ supply tube 42 is J-shaped and directed upward, the protection liquid 52 surfaces on the tip end of the PSZ supply tube 42. Therefore, the protection liquid 52 is not supplied to a discharge portion 44.

In the second embodiment, the protection liquid 52 may be also used in a waste liquid container provided below a spin coater. If so, a waste liquid is thereby out of contact with the air. The second embodiment is, therefore, more preferable in environmental and safety aspects.

The semiconductor manufacturing apparatus 40 and the PSZ container 50 according to the second embodiment are relatively inexpensive and can be realized by simple changes in designs of the conventional semiconductor manufacturing apparatus and the conventional PSZ container, respectively.

Third Embodiment

Figure 9:
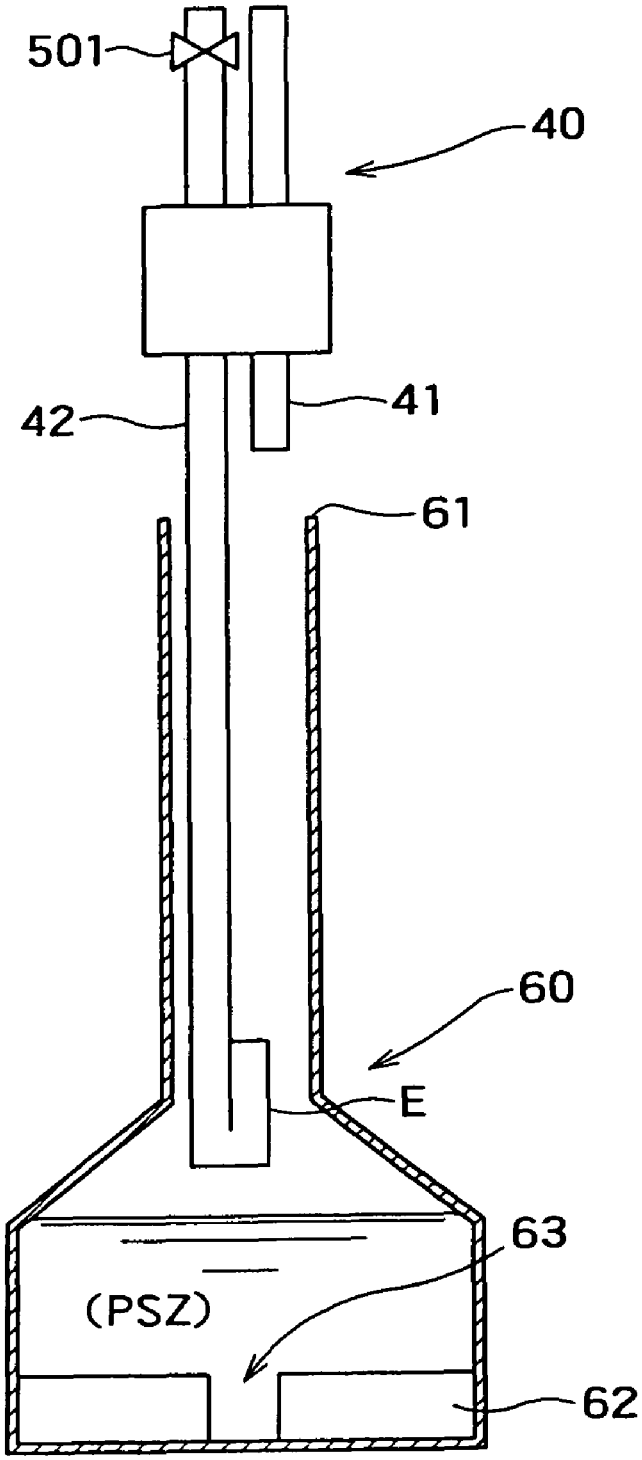
FIG. 9 is a cross-sectional view of a PSZ container according to a third embodiment of the present invention.

FIG. 9 is a cross-sectional view of a semiconductor manufacturing apparatus 40 and a PSZ container 60 according to a third embodiment of the present invention. The PSZ container 60 according to the third embodiment includes a narrow opening portion 61 and a concave portion 63 that can accept a J-shaped tip end E of a PSZ supply tube 42. The semiconductor manufacturing apparatus 40 is identical to the semiconductor manufacturing apparatus 40 according to the second embodiment.

According to the third embodiment, since the opening portion 61 is narrow, an area by which a PSZ liquid contacts with the air can be made small. In addition, by inserting the tip end E of the PSZ supply tube 42 into the concave portion 63, the PSZ liquid can be made most use of to the end.

The semiconductor manufacturing apparatus 40 and the PSZ container 60 according to the third embodiment are also relatively inexpensive and can be realized by simple changes in designs of the conventional semiconductor manufacturing apparatus and the conventional PSZ container, respectively.

Fourth Embodiment

Figure 10:
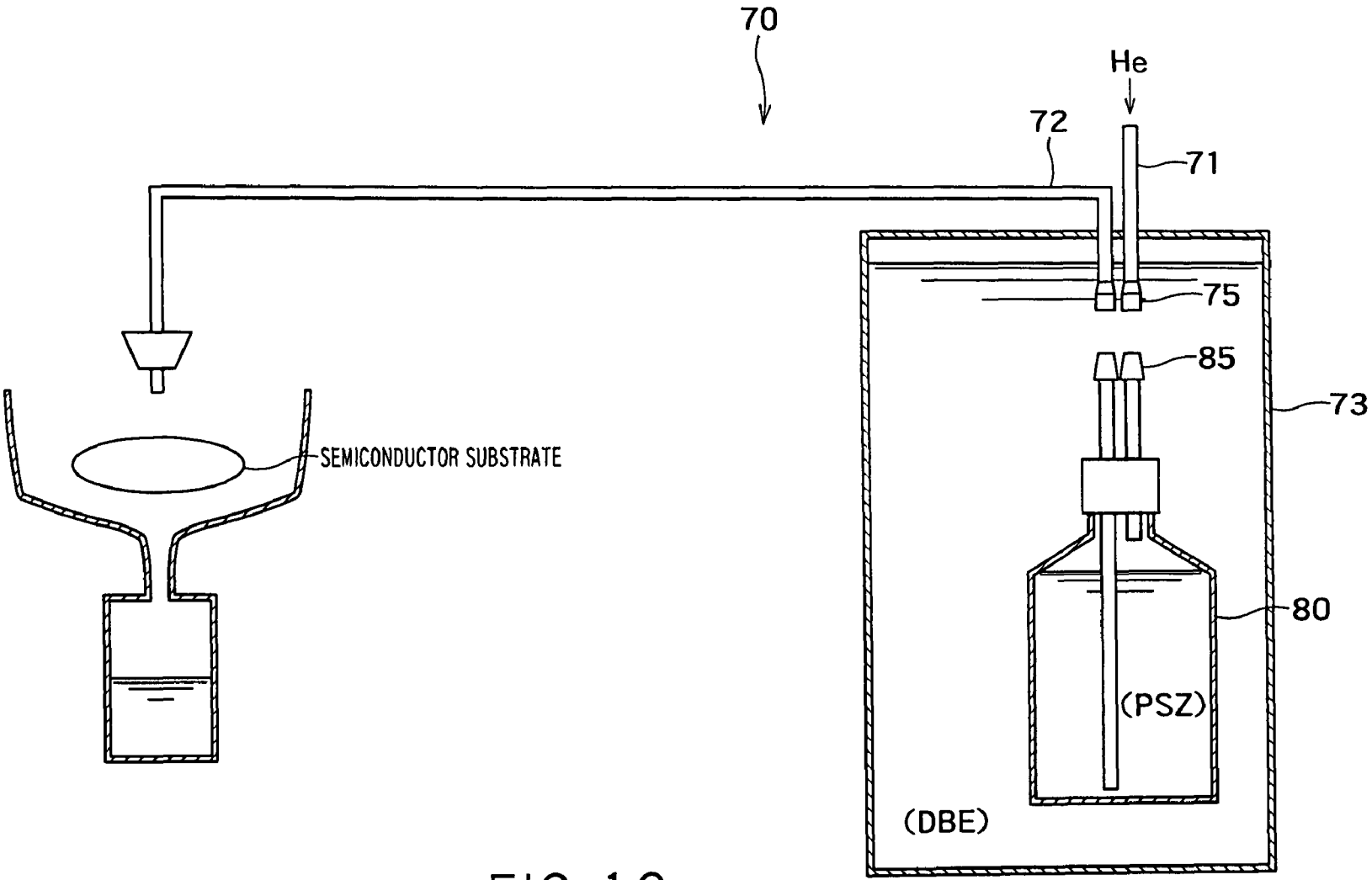
FIG. 10 is a schematic diagram of a semiconductor manufacturing apparatus and a PSZ container according to a fourth embodiment of the present invention.

FIG. 10 is a schematic diagram of a semiconductor manufacturing apparatus 70 and a PSZ container 80 according to a fourth embodiment of the present invention. The semiconductor manufacturing apparatus 70 differs from the semiconductor manufacturing apparatus shown in FIG. 14 in that the apparatus 70 includes a liquid bath 73 that contains a DBE liquid. A PSZ supply tube 72 and a He supply tube 71 are inserted into the liquid bath 73, and a tip end of the PSZ supply tube 72 and that of the He supply tube 71 are arranged below a liquid level of the DBE liquid.

Female connectors 75 are provided at tip ends of the He supply tube 71 and the PSZ supply tube 72, respectively, and corresponding male connectors 85 having a valve are provided at the PSZ container 80. By one-touch connection between the female connectors 75 and the corresponding male connectors 85, the PSZ container 80 is connected to the He supply tube 71 and the PSZ supply tube 72.

Attachment and detachment of the PSZ container 80 to and from the semiconductor manufacturing apparatus 70 are executed in the DBE liquid. Therefore, the air does not contact with the PSZ liquid. Since the DBE liquid is contained in the PSZ container 80 as a solvent for the PSZ liquid, no problem occurs even if a small amount of the DBE liquid is mixed into the PSZ container 80.

Furthermore, the semiconductor manufacturing apparatus and the PSZ container 80 according to the fourth embodiment are also relatively inexpensive, and can be realized by simple changes in designs of the conventional semiconductor manufacturing apparatus and the conventional PSZ container, respectively.

A material for the PSZ container 80 may be a flexible material such as polyethylene in place of glass. When the PSZ container 80 consists of the flexible material and the air is mixed into the male connectors 85, the air can be easily removed by an operator's compressing the PSZ container 80 by an operator's hand after the PSZ container 80 is dipped into the liquid bath 73. It is noted that the DBE liquid does not flow backward into the PSZ container 80 since the respective male connectors 85 include valves.

Fifth Embodiment

Figure 11:
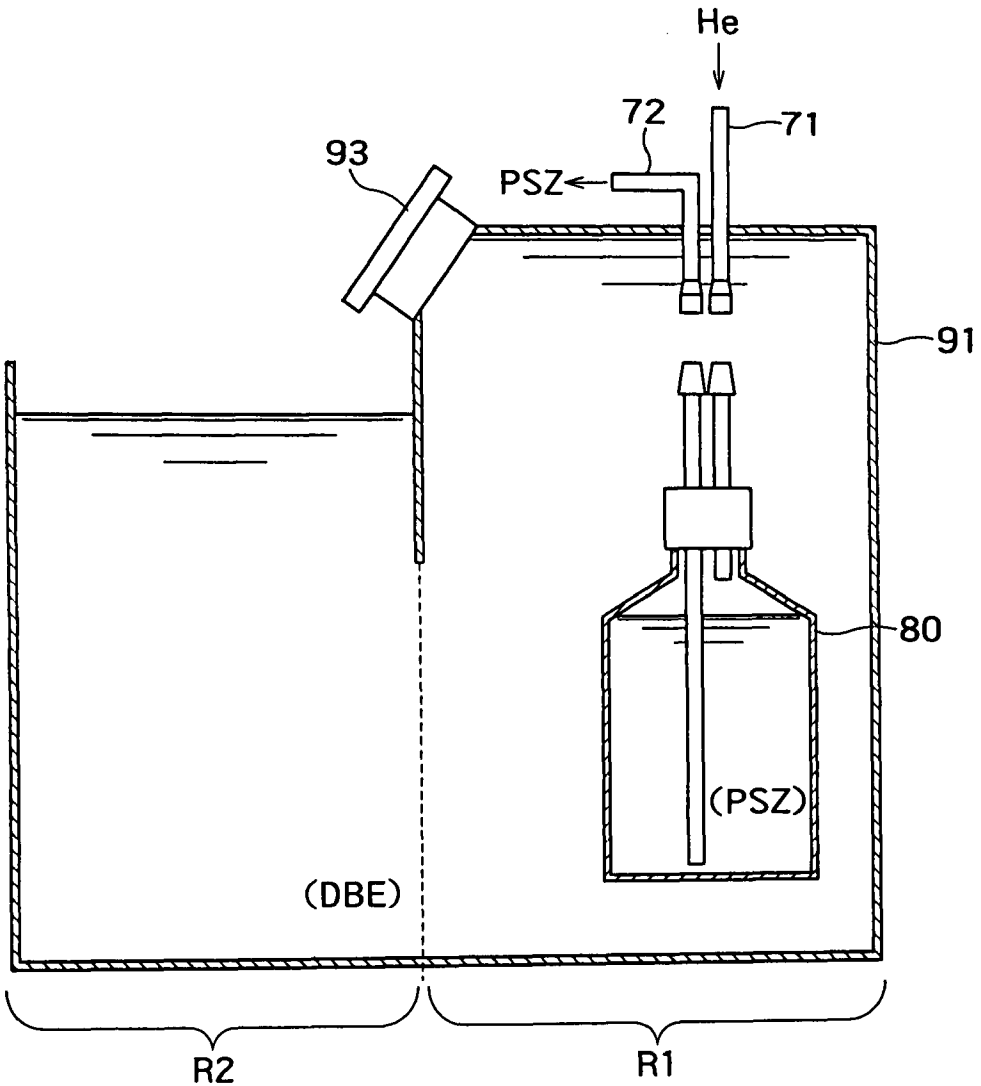
FIG. 11 is a schematic diagram of a semiconductor manufacturing apparatus and a PSZ container according to a fifth embodiment of the present invention.

FIG. 11 is a schematic diagram of a semiconductor manufacturing apparatus and a PSZ container 80 according to a fifth embodiment of the present invention. The fifth embodiment differs from the fourth embodiment in a shape of a liquid bath. 91. Other constituent elements in the fifth embodiment may be identical to those in the fourth embodiment. A region R1 of the liquid bath 91, into which a tip end of a He supply tube 71 and that of a PSZ supply tube 72 are inserted, is filled with a DBE liquid. Therefore, a PSZ liquid does not contact with not only the air but also a gas such as He.

A region R2 of the liquid bath 91 has an upper opening portion. The PSZ container 80 can be attached to the He supply tube 71 and the PSZ supply tube 72 by operator's inserting the PSZ container 80 into the liquid bath 91 from this opening portion. The liquid bath 91 includes a porthole 93. The operator can, therefore, connect the PSZ container 80 to the He supply tube 71 and the PSZ supply tube 72 while viewing the liquid bath 91 from the porthole 93.

Sixth Embodiment

Figure 12:
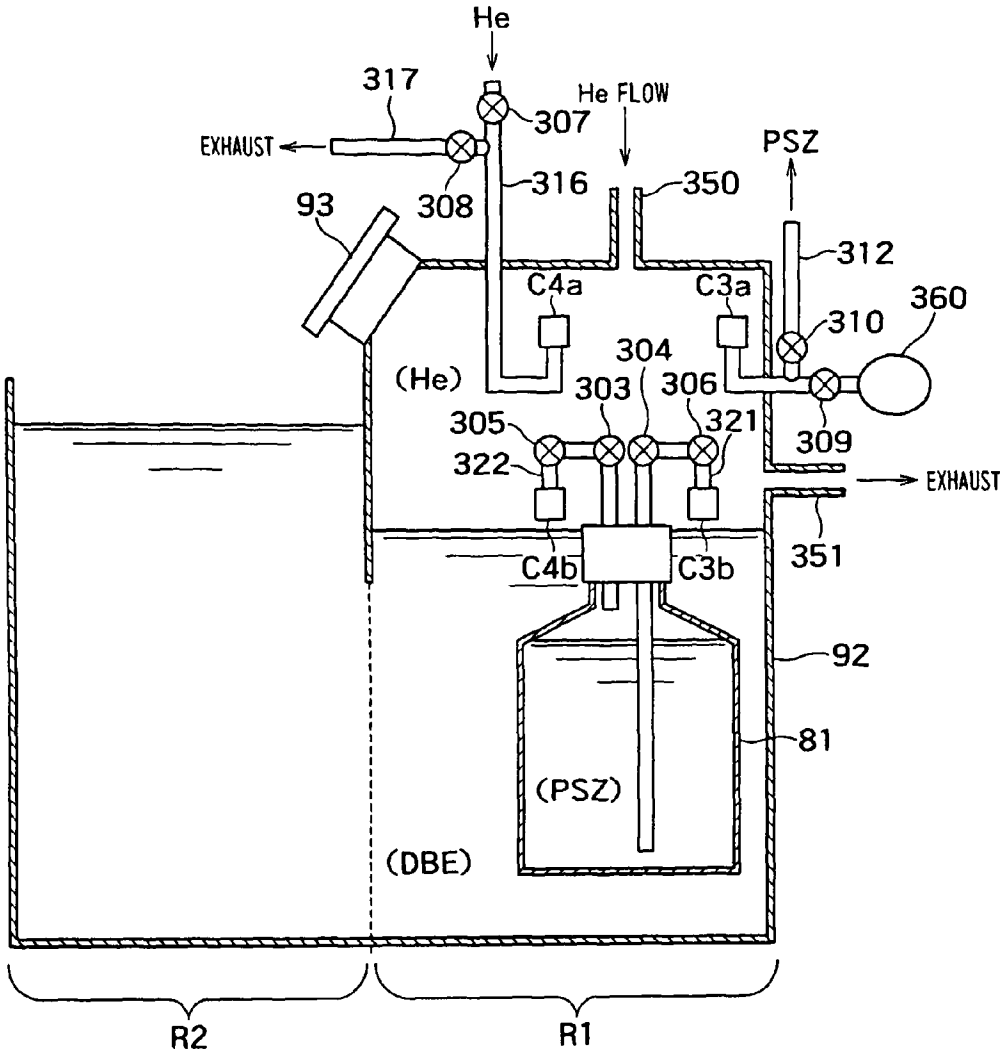
FIG. 12 is a schematic diagram of a semiconductor manufacturing apparatus and a PSZ container according to a sixth embodiment of the present invention.

FIG. 12 is a schematic diagram of a semiconductor manufacturing apparatus and a PSZ container 81 according to a sixth embodiment of the present invention. In the fourth and the fifth embodiments, the attachment and detachment of the PSZ container are executed in the DBE liquid. In the sixth embodiment, the attachment and detachment of the PSZ container are executed in a He gas atmosphere.

An upper portion of a region R1 of the PSZ container 81 is filled with the He gas. A liquid bath 92 includes a supply port 350 for supplying the He gas and an exhaust port 351 for exhausting the air or the like mixed into the liquid bath 92 together with the He gas. By so constituting, even if the gas other than the He gas is mixed into the PSZ container 81 while the PSZ container 81 is being replaced with another container 81, the gas can be exhausted.

In the semiconductor manufacturing apparatus, a connector C3*a* is connected to a PSZ supply tube 312 through a valve 310, and also connected to a balloon 360 through a valve 309. A connector C4*a* is connected to a He supply tube 316. The balloon 360 consists of, for example, a rubber having a high elasticity and a low reaction with the PSZ liquid. The balloon 360 is filled with the PSZ liquid in advance. A valve 307 is provided at the He supply tube 316, and an exhaust tube 317 is connected between the valve 307 and the connector C4*a* through a valve 308.

A PSZ outlet tube 321 and a He inlet tube 322 of the PSZ container 81 include two valves 304 and 306 and two valves 303 and 305, respectively. Connectors C3*b* and C4*b* of the PSZ outlet tube 321 and the He inlet tube 322 are formed to be directed downward. The PSZ outlet tube 321 from the PSZ container 81 to the valve 304 is filled with the PSZ liquid in advance, and a piping between the valves 303 and 305 and a piping between the valves 304 and 306 are each filled with a pressurized He gas in advance.

An operation for attaching the PSZ container 81 to the semiconductor manufacturing apparatus will be described. The PSZ container 81 is moved into the liquid bath 92 so that the connectors C3*b* and C4*b* are provided in the He gas atmosphere in the region R1 (at a step S300). At this time, the air may possibly remain in a piping from the valve 306 to the connector C3*b* and a piping from the valve 305 to the connector C4*b*. Considering this, by opening the valves 305 and 306, the pressurized He gas is ejected (at a step S310). By doing so, the air is discharged to the outside of the connectors C3*b* and C4*b*. Since the air is higher in specific gravity than the He gas, the air is moved to a liquid level of the DBE liquid and exhausted from the exhaust port 351.

Thereafter, the connector C3*a* is connected to the connector C3*b* and the connector C4*a* is connected to the connector C4*b* (at a step S320). At this time, the valves 307, 308, 309, and 310 are closed. The valves 309 and 308 are then opened in this order (at a step S330). The balloon 360 filled with the PSZ liquid is thereby contracted and the He gas residing in a piping from the valve 304 to the valve 309 is returned into the PSZ container 81.

After closing the valves 308 and 309 in this order, the valves 307 and 310 are opened in this order (at a step S340). The He supply tube 316 thereby supplies the He gas into the PSZ container 81 and the PSZ liquid is supplied to a discharge portion through the PSZ supply tube 312.

When the PSZ container 81 is to be detached from the semiconductor manufacturing apparatus, then the valve 310 is closed, and the valve 309 is closed after the balloon 360 is filled with the PSZ liquid to some degree. After closing all the valves 303 to 308, the PSZ container 81 is detached.

According to the fifth embodiment, the PSZ container 81 can be replaced by a new PSZ container 81 in an environment shut off from the air while preventing mixture of the He gas.

As described above, in the embodiments, it is preferable that the PSZ liquid is discharged onto a dummy wafer before being coated on a desired wafer. This is because the DBE liquid may possibly enter the PSZ container 81 during the replacement.

The embodiments may be executed in combination. For example, the PSZ container 50 shown in FIGS. 7 and 8 can be applied to any one of the first and the third to the fifth embodiments.

FIG. 13 is a table that shows effects of the respective embodiments. In the table of FIG. 13, the numbers of particles generated when the PSZ liquid is coated on the semiconductor substrate at the SOG step are shown. In the conventional technique shown in FIG. 14, many particles having respective particle diameters are generated. In the first to the sixth embodiments, particles having particle diameters of 0.2 to 1.0 μm are hardly generated. According to the embodiments of the present invention, therefore, it is expected to improve the yield of semiconductor devices.

In the respective embodiments of the present invention, the coating liquid is not limited to the PSZ liquid but may be any coating liquid for forming a silica-containing film or the like.

The invention claimed is:

1. A semiconductor manufacturing method using a semiconductor manufacturing apparatus comprising a discharge portion discharging a coating liquid onto a substrate; a gas supply tube pressurizing an interior of a liquid container with an inert gas; a coating liquid supply tube airtightly supplying the coating liquid from the liquid container to the discharge portion using pressurization from the gas supply tube; a first connecting portion capable of attaching and detaching the liquid container to and from the coating liquid supply tube; a second connecting portion capable of attaching and detaching the liquid container to and from the gas supply tube; an exhaust tube capable of reducing an internal pressure of the coating liquid supply tube including the first connecting portion; and a solvent supply tube supplying a solvent, which can dissolve the coating liquid, to the first connecting portion;

the method comprising:

attaching the liquid container to the first connecting portion and the second connecting portion;

supplying the inert gas to the liquid container via the gas supply tube, thereby carrying the coating liquid to the discharge portion via the coating liquid supply tube;

discharging the coating liquid to the substrate from the discharge portion;

reducing an internal pressure of the liquid container via the exhaust tube and the second connecting portion after discharging the coating liquid; and returning the coating liquid in the first connecting portion and the liquid supply tube to the liquid container by using the pressure in the liquid container, the method further comprising:

supplying the solvent to the first connecting portion and to the coating liquid supply tube, therewith returning the coating liquid in the first connecting portion and the liquid supply tube to the liquid container.

2. The semiconductor manufacturing method according to claim 1, wherein the coating liquid is a perhydropolysilazane liquid, and the solvent capable of dissolving the coating liquid is a dibutyl ether.

3. A method of manufacturing a semiconductor device using a semiconductor manufacturing apparatus comprising:

a discharge portion discharging a coating liquid onto a semiconductor substrate;

a liquid container containing the coating liquid;

a gas supply tube pressurizing an interior of the liquid container with an inert gas;

a coating liquid supply tube airtightly supplying the coating liquid from the liquid container to the discharge portion using pressurization from the gas supply tube;

a first connecting portion capable of attaching and detaching the liquid container to and from the coating liquid supply tube;

a second connecting portion capable of attaching and detaching the liquid container to and from the gas supply tube;

an exhaust tube capable of reducing an internal pressure of the interior of the liquid container through the second connecting portion;

a first valve opening or closing between the first connecting portion and the liquid container;

a second valve opening or closing between the second connecting portion and the liquid container; and a solvent supply tube supplying a solvent, which can dissolve the coating liquid, to the first connecting portion;

the method comprising:

carrying the coating liquid to the discharge portion through the coating liquid supply tube by supplying the inert gas to the liquid container through the gas supply tube;

discharging the coating liquid to the substrate from the discharge portion;

after discharging the coating liquid, reducing an internal pressure of the liquid container through the exhaust tube, the second connecting portion and the second valve, in a state of closing the first valve and opening the second valve;

returning the coating liquid in the first connecting portion and the liquid supply tube to the liquid container by using the reduced internal pressure in the liquid container, and supplying the solvent from the solvent supply tube to the first connecting portion and the liquid supply tube, in a state of closing the second valve and opening the first valve;

connecting the gas supply tube to the liquid supply tube;

flowing the solvent in the liquid supply tube and the first connecting portion to the liquid container by supplying the inert gas to the liquid container through the liquid supply tube; and detaching the liquid container from the first and the second connecting portions after closing the first and the second valves.

4. The semiconductor manufacturing method according to claim 3, further comprising:

attaching the liquid container to the first and the second connecting portions;

reducing an internal pressure of the coating liquid supply tube and the first connecting portion through the exhaust tube in a state that the first and the second valves are closed;

supplying the coating liquid from the liquid container to the coating liquid supply tube and the first connecting portion by using the reduced internal pressure in the coating liquid supply tube after opening the first valve;

mixing the solvent from the solvent supply tube with the coating liquid in the coating liquid supply tube;

supplying the mixture liquid of the coating liquid and the solvent to the discharge portion by using a pressurization from the gas supply tube after opening the first and the second valves; and supplying the coating liquid in the liquid container to the discharge portion.

5. The semiconductor manufacturing method according to claim 3, wherein the coating liquid is any coating liquid for forming a silica-containing film.

6. The semiconductor manufacturing method according to claim 3, wherein the solvent capable of dissolving the coating liquid is a dibutyl ether.

* * * * *